US005629709A

United States Patent [19]

Yamashita

[11] Patent Number: 5,629,709

[45] Date of Patent: May 13, 1997

[54] TRACKING CONTROL DEVICE OF ANTENNA LOADED ON MOVABLE BODY AND TRACKING CONTROL METHOD OF THE ANTENNA

[75] Inventor: Toshiaki Yamashita, Tokyo, Japan

[73] Assignee: NEC Corporation, Japan

[21] Appl. No.: 333,046

[22] Filed: Nov. 1, 1994

[30] Foreign Application Priority Data

Nov. 2, 1993 [JP] Japan ..... 5-274223

[51] Int. Cl.[6] ..... H01Q 3/00

[52] U.S. Cl. ..... 342/359

[58] Field of Search ..... 342/359, 75, 77; 343/757

[56] References Cited

U.S. PATENT DOCUMENTS 4,630,056 12/1986 Noguchi et al. ..... 342/359
4,725,843 2/1988 Suzuki et al. ..... 342/359
4,841,303 6/1989 Anderson ..... 342/359
5,241,319 8/1993 Shimizu ..... 342/359

FOREIGN PATENT DOCUMENTS 63-271182 11/1988 Japan .

*Primary Examiner*—Gregory C. Issing
*Attorney, Agent, or Firm*—Ostrolenk, Faber, Gerb & Soffen, LLP

[57] ABSTRACT

An antenna tracking control device includes detectors for detecting speed and the steering angle of a movable body, a device for calculating the estimated azimuth angle of the movable body based on the detected speed and steering angle, and a detector for detecting the azimuth angle of the movable body. Also, an azimuth angle error estimator is provided for calculating the error between the calculated estimated azimuth angle and the detected azimuth angle. In addition, a directing angle error detector is used for detecting antenna directing angle error, and a directing angle error corrector is used for correcting the detected antenna directing angle error, with the result that the antenna tracking control device causes an antenna mounted on a moveable body, such as an automobile, to track a wave generating source based on the corrected antenna directing angle error.

28 Claims, 5 Drawing Sheets

TRACKING CONTROL DEVICE OF ANTENNA LOADED ON MOVABLE BODY AND TRACKING CONTROL METHOD OF THE ANTENNA

BACKGROUND OF THE INVENTION

The present invention relates to a control device for directing an antenna disposed on a movable body such as aircraft, vehicles, ships or the like to a wave generating source.

In satellite communication systems using an antenna disposed on movable body, the antenna is controlled to track the satellite under consideration of the movable body's location and change of the movable body's attitude, since it is necessary at all times to direct the antenna to the satellite.

As a prior art for antenna tracking control described above, an invention disclosed in Japanese Patent Laid-Open No. 271182 (1988) is explained below.

FIG. 5 is a block diagram showing an example of a body tracking control device of antenna loaded on movable body. Where, 51 is an antenna, 52 is an antenna directing angle error detector, 53 is a movable body azimuth angle detector, 54 is an antenna directing angle error corrector, 55 is an antenna tracking controller and 56 is an antenna driving motor.

First of all, the antenna directing angle error detector 52 calculates a difference between satellite direction and antenna beam direction, that is, antenna directing error and outputs an antenna directing angle error signal x.

On the other hand, the movable body azimuth angle detector 53 detects azimuth angle of the movable body and outputs a movable body azimuth angle signal y.

The antenna directing angle error corrector 54 inputs the antenna directing angle error signal x and the movable body azimuth angle signal y, corrects the antenna directing angle error signal x using the movable body azimuth angle signal y and outputs an antenna directing angle error correction signal z.

Then, the antenna tracking controller 55 controls the antenna driving motor 56 to direct the antenna 51 to the satellite, based on the antenna directing angle error correction signal z.

Providing for a case that the antenna directing angle error detector 52 cannot detect the antenna directing angle error signal x, a number of satellites' orbit data, as well as the antenna directing angle error signal x, are prepared in advance for the antenna tracking controller 55.

Only when input of the antenna directing angle error signal x is stopped, the antenna tracking controller 55 controls the antenna driving motor 56 using a pseudo antenna error signal generated from the satellites' orbit data and the movable body azimuth angle signal y.

In the above-mentioned art for controlling tracking of antenna loaded on a movable body, however, detection of azimuth angle of a movable body when the movable body changes advancing direction is delayed in the movable body azimuth angle detector 53. If the movable body is an automobile, for example, at the time when the handle is operated to steer tires, azimuth angle of the automobile is not changed yet because the automobile does not move enough. Therefore, it is not possible at this time to anticipate and detect advancing azimuth angle of the automobile.

In this system, if the antenna directing angle error signal x is corrected using the azimuth angle detected by the movable body azimuth angle detector 53, it is not possible to correct it without any time lag due to time needed for correction processing, etc.

In addition, antenna tracking response speed of such an art is limited by a dead time of the antenna tracking controller 55 and a time lag in the antenna directing angle error detector 52.

SUMMARY OF THE INVENTION

It is an object of the present invention to provide an art of antenna tracking control that enables accurate and quick antenna tracking control.

The above object of the present invention is achieved by a tracking controller of antenna loaded on movable body that controls an antenna loaded on a movable body so as to track a wave generating source, comprising:

a speed detection means for detecting speed of the movable body; a steering angle detection means for detecting steering angle of movable body; an estimated azimuth angle calculation means for calculating estimated azimuth angle of the movable body, based on the speed detected by the speed detection means and the steering angle detected by the steering angle detection means; an azimuth angle detection means for detecting azimuth angle of the movable body; an error calculation means for calculating error between the estimated azimuth angle calculated by the estimated azimuth angle calculation means the azimuth angle detected by the azimuth angle detection means; a directing angle error detection means for detecting antenna directing angle error; and a correction means for correcting the antenna directing angle error, based on the error calculated by the error calculation means.

The present invention configured as above detects direct advance speed and steering angle, and estimates change of azimuth angle of a movable body, using their signals. Then, the present invention corrects directing angle error between an antenna, using an error of estimated azimuth angle and azimuth angle actually detected.

By configuring as above, it becomes possible to reduce error between the detected azimuth angle of movable body and the actual azimuth angle or movable body, so accurate antenna tracking becomes possible.

This and other objects, features and advantages of the present invention will become more apparent upon a reading of the following detailed description and drawings.

DESCRIPTION OF THE PREFERRED EMBODIMENT

A first embodiment of the present invention is subsequently described with reference to FIG. 1.

Figure 1:
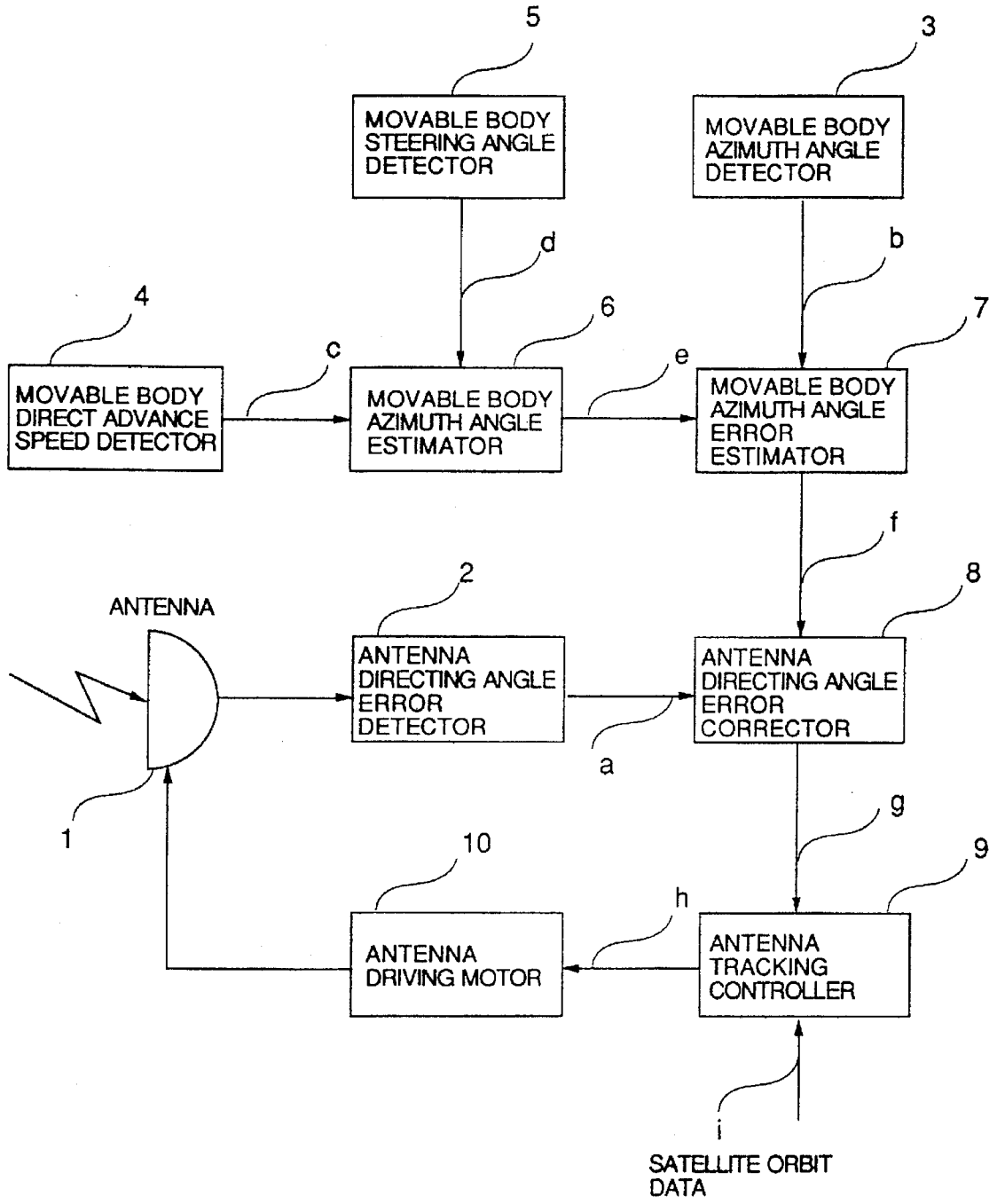
FIG. 1 is a block diagram of the first embodiment of the present invention.

In FIG. 1, the numeral 1 denotes an antenna disposed on a movable body, such as an automobile.

An antenna directing angle error detector 2 is used for detecting a difference between the central beam direction of the antenna 1 and direction of a communications satellite, that is, an antenna directing angle error and outputting an antenna directing angle error detection signal a.

A movable body azimuth angle detector 3 is, for example, a gyro compass and the like. This movable body azimuth angle detector 3 detects azimuth angle θ that is formed by the direction of an automobile 20 and a preset x axis, and outputs a movable body azimuth angle detection signal b, as shown in FIG. 2.

A movable body direct advance speed detector 4 is used for detecting the advancing speed v of the automobile 20 and outputs an advancing speed detection signal c.

Figure 2:
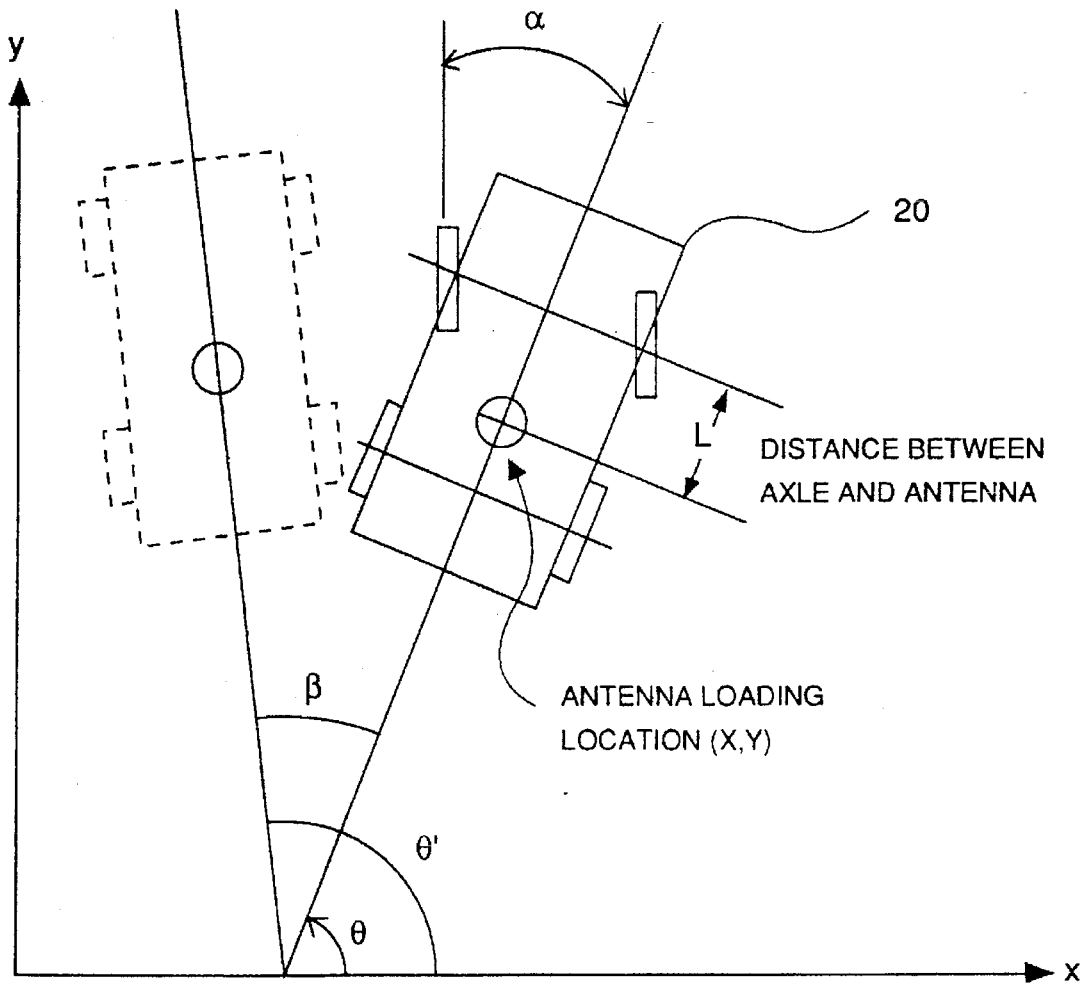
FIG. 2 is a figure for explaining the first embodiment.

A movable body steering angle detector 5 is used for detecting steering angle e of the automobile 20 as shown in FIG. 2 and outputs a movable body steering angle detection signal d.

A movable body estimated azimuth angle calculator 6 inputs the advancing speed detection signal c and the movable body steering angle detection signal d and calculates an estimated azimuth angle θ' of the automobile 20 anticipated after a preset time from start of steering. This estimation of the estimated azimuth angle θ' is conducted as below.

At first, as shown in FIG. 2, letting a distance between an axle of the automobile 20 and the location of the antenna be L, and azimuth angle speed of the automobile 20 be ω, the azimuth angle speed ω is calculated by the following equation.

$$\omega=(v/L)\tan\alpha \quad (1)$$

Where, equation (1) is quoted from p. 43 of No. 156 of Report of machinery technology institute, .MITI, Japan.

Next, the azimuth angle speed ω calculated by the equation (1) is integrated by an integrator in the movable body azimuth angle estimator 6 based on the following equation (2).

$$\theta'_n=\theta'_{n-1}+\omega\cdot T \quad (2)$$

Where, n=1, 2, . . . , i, T is a sampling time, $\theta'_{n-1}$ is an estimated azimuth angle of one sampling time previous from $\theta'_n$.

By conducting the above integration for a preset time, the estimated azimuth angle θ' after a preset time is obtained. Then, the movable body estimated azimuth angle calculator 6 outputs the calculated estimated azimuth angle θ' as a movable body estimated azimuth angle signal e.

A movable body azimuth angle error calculator 7 inputs the movable body azimuth angle detection signal b and the movable body estimated azimuth angle signal e and outputs a difference between the movable body azimuth angle detection signal b and the movable body azimuth angle error calculation signal f showing azimuth angle error β.

An antenna directing angle error corrector 8 inputs the antenna directing angle error detection signal a and the movable body azimuth angle error calculation signal f, corrects an antenna directing angle error by calculating an arithmetical mean of the antenna directing angle error detection signal a and the movable body azimuth angle error calculation signal f and outputs an antenna tracking control signal g.

An antenna tracking controller 9 generates a driving control signal h to drive the antenna 1 so that the input antenna tracking control signal g becomes zero. It is to be noted that the antenna tracking controller 9 comprises a PI controller combined with an integrator to improve gain and steady characteristics. By configuring like this, the antenna tracking controller 9 can generate the driving control signal h making the antenna tracking control signal g zero. In addition, for a countermeasure to a case that the antenna directing angle error signal a cannot be obtained by a reason of wave shielding or the like, the antenna tracking controller 9 inputs satellites' orbit data i similar to a prior art as well as the antenna tracking control signal g. It is configured similar to the prior art when wave shielding exists.

An antenna driving motor 8 drives the antenna 1, based on the driving control signal h.

Next, operations of the first embodiment configured as above are explained.

First, supposing that the automobile 20 is at the location shown by the solid line in FIG. 2, the handle of the automobile 20 is supposed to be operated at this location in direct advance speed v and steering angle α. At this moment, the tires are steered in the steering angle α, but there is a time lag til the body of the automobile 20 moves. By reason of this, the movable body azimuth angle detector 3 can detect only the azimuth angle θ at the location shown by the solid line in FIG. 2.

For avoiding this problem, the movable body estimated azimuth angle calculator 6 calculates the estimated azimuth angle θ' using direct advance speed v and steering angle α that have been detected by the movable body direct advance speed detector 4 and the movable body steering angle detector 5.

By configuring as this, it becomes possible to anticipate the automobile 20's azimuth angle after a preset time from the time when the handle has been steered. Then, the movable body azimuth angle error calculator 7 calculates an azimuth angle error and outputs the movable body azimuth angle error calculation signal f.

On the other hand, the antenna directing angle error detector 2 can detect only the antenna's directing angle error at the location that the automobile 20 is at the solid line in FIG. 2. Then, the antenna directing angle error corrector 8 calculates an arithmetical means of the antenna directing angle error detection signal a and the movable body azimuth angle error calculation signal f and corrects the antenna directing angle error detection signal a.

By this configuration, the antenna tracking control signal g output from the antenna directing angle error corrector 8 becomes a signal that prefetched movement of the automobile 20, so quick tracking of the antenna 1 becomes possible.

Next, a second embodiment is explained.

In this second embodiment, the method of correction conducted by the antenna directing angle error corrector 8 in the first embodiment is changed.

As the correction method in the second embodiment, a weighted mean of the antenna directing angle error signal a and the movable body azimuth angle error calculation signal f is calculated and the obtained signal is output as the antenna tracking controller signal g.

Concretely describing, simply supposing that the antenna directing angle error signal a is a and the movable body azimuth angle error calculation signal f is f, the antenna tracking controller signal g becomes a signal generated by the equation, (mg+nh)/m+n. It is to be noted that m and n are weighting constants for each signal. These values of the constants are decided by practical adjustment.

As a further explanation of the present invention, the following is a discussion of the simulation of an actual system of the present invention.

Figure 3:
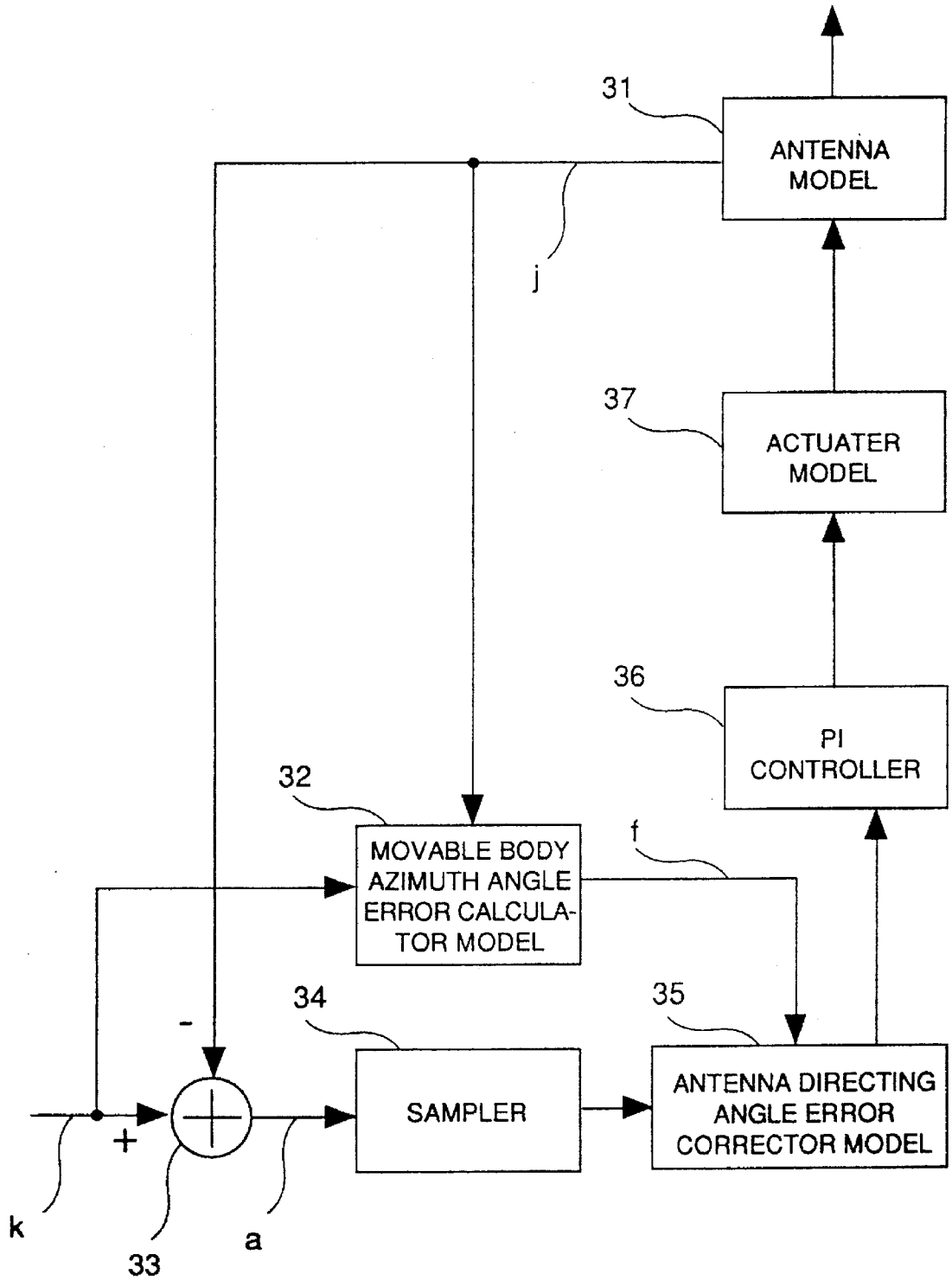
FIG. 3 is a block diagram for explaining a simulation of the present invention.

FIG. 3 is a block diagram of the present invention in the simulated system.

In FIG. 3, 31 is an antenna model, 32 is a movable body azimuth angle error calculator model, 33 is an adder, 34 is a sampler, 35 is an antenna directing angle corrector model, 36 is a PI controller (antenna tracking controller) and 37 is an actuator model (antenna driving motor).

The movable body azimuth angle error calculator model 32 simulates generation of the movable body azimuth angle error calculation signal f of the above-mentioned embodiment.

The movable body azimuth angle error calculator 32 inputs the antenna directing angle j showing direction of the antenna model 31 and the target directing angle k showing direction of the target, and simulates and generates the movable body azimuth angle error calculation signal f.

On the other hand, the antenna directing angle j and the target directing angle k are input to the adder 33 and a difference between them are calculated to generate the antenna directing angle error signal a. This antenna directing angle error signal a is input to the sampler 34 and a dead time is created.

Configured as this, the movable body azimuth angle error calculation signal f becomes a future value for the dead time against the antenna directing angle error signal a.

The antenna directing angle error corrector model 35 calculates an arithmetical mean and a weighted mean of the antenna directing angle error signal a and the movable body azimuth angle error calculation signal f, and outputs a result.

A DC servo motor model is used for the actuator model 37, and a rigid model is used for the antenna model 31 in this simulation.

Figure 4:
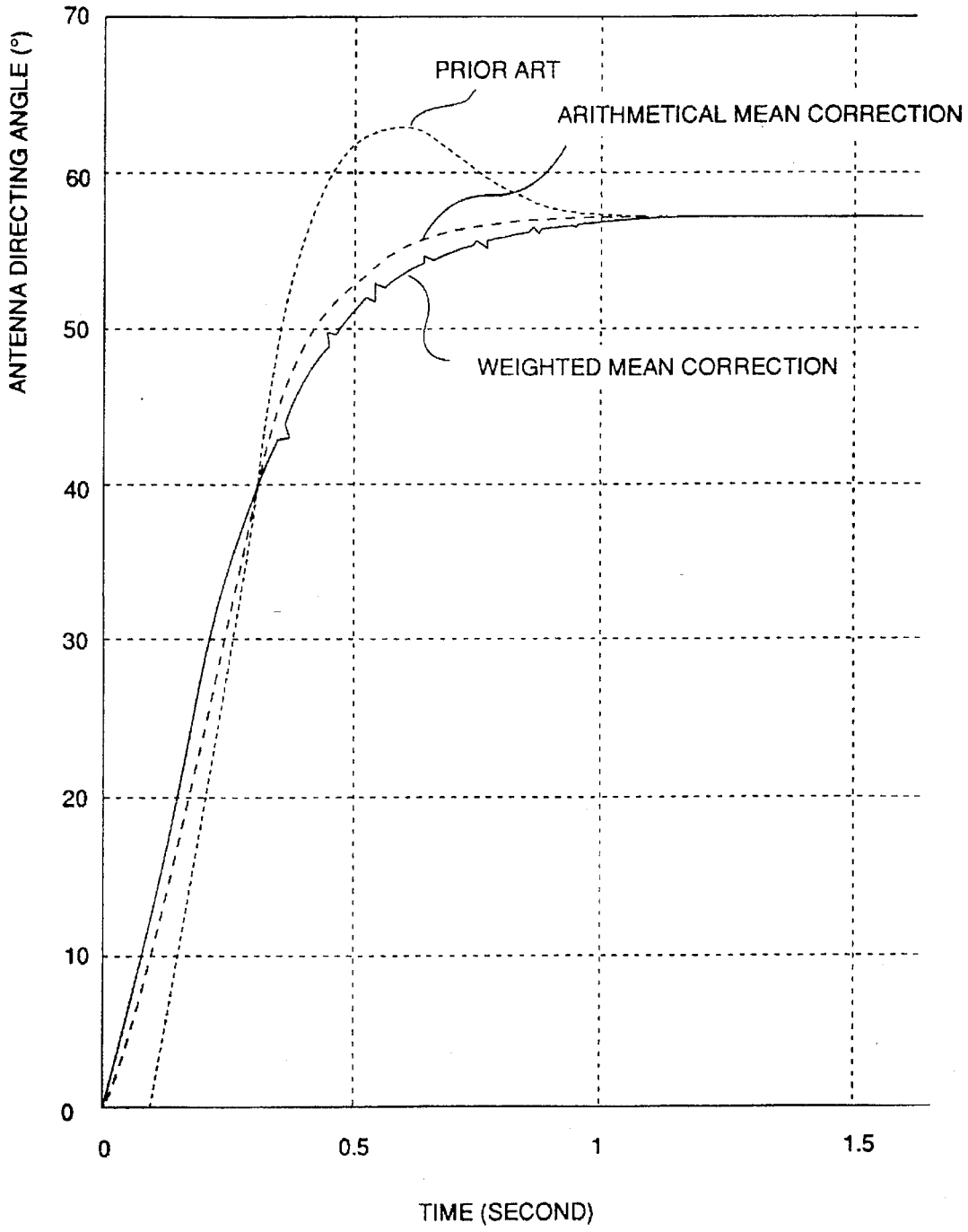
FIG. 4 is a graph showing the results of the simulation.
Figure 5:
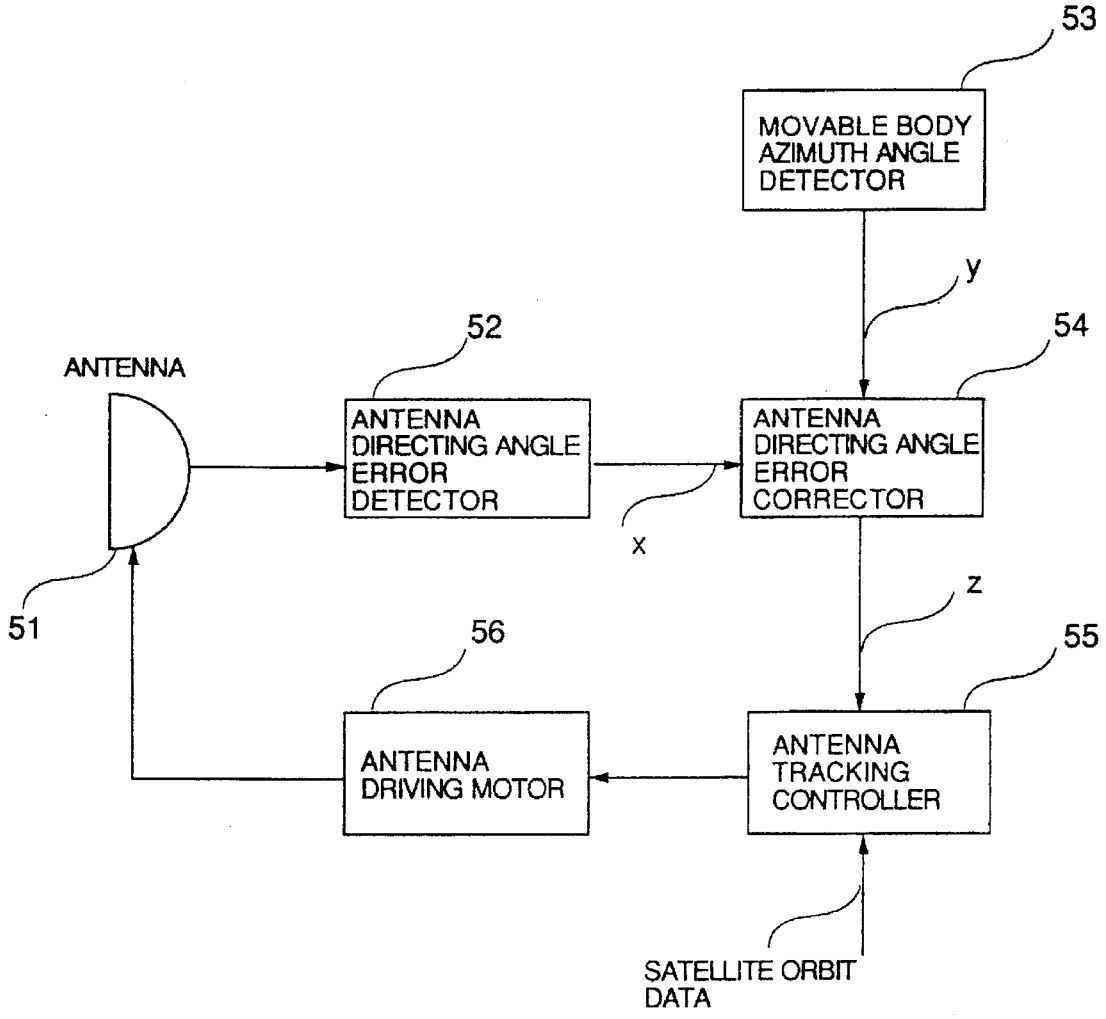
Fig.5 PRIOR ART
FIG. 5 is a block diagram for explaining a prior tracking art of antenna loaded on movable body.

A simulation result of the above-mentioned configuration is shown in FIG. 4. Where, the solid line shows a case that a weighted mean is used in the antenna directing angle error corrector model 35, the broken line shows a case of an arithmetical mean for that and dotted line shows a case using a prior device without any correction. It is to be noted that m=3 and n=6 are used for weighting constants for weighting correction.

As shown by the dotted line in FIG. 4, in the prior device not using the movable body azimuth angle error calculator model 32, generation of overshoot is confirmed due to deterioration of transient response when proportional gain of the PI controller 36 for enhancing tracking ability to movement of target.

Contrary to this, in cases that the antenna directing angle error signal a is corrected using the movable body azimuth angle error calculator model 32, both cases of using an arithmetical mean and a proper weighted mean, it is confirmed that transient characteristics are improved so the response in these cases is better than a prior device. As this result, an antenna tracking controller having accuracy and a measure of readiness can be realized.

In addition, it is obvious that the present invention can be applied to not only automobiles but also aircraft, ships, etc., for example, to a movable body that uses its azimuth angle for tracking control, although an automobile is used as an example of a movable body in this embodiment.

What is claimed is:

1. A tracking control device for an antenna disposed on a movable body so as to track a wave generating source, said tracking control device comprising:

a speed detection means for detecting a speed of said movable body;

a steering angle detection means for detecting a steering angle of said movable body;

an estimated azimuth angle calculation means for calculating an estimated azimuth angle of said movable body, based on the speed detected by said speed detection means and the steering angle detected by said steering angle detection means;

an azimuth angle detection means for detecting an azimuth angle of said movable body;

an error calculation means for calculating an error between said estimated azimuth angle calculated by said estimated azimuth angle calculation means and said azimuth angle detected by said azimuth angle detection means;

a directing angle error detection means for detecting an antenna directing angle error; and a correction means for correcting said antenna directing angle error, based on said error calculated by said error calculation means.

2. The tracking control device of claim 1, wherein said speed detection means detects an advancing speed of said movable body.

3. The tracking control device of claim 1, wherein said estimated azimuth angle calculation means calculates azimuth angle speed of said movable body based on said speed detected by said speed detection means and said steering angle detected by said steering angle detection means and calculates said estimated azimuth angle of said movable body by integrating said azimuth angle speed.

4. The tracking control device of claim 3, wherein said estimated azimuth angle calculation means calculates azimuth angle speed $\omega$ of said movable body by the following equation, $$\omega=(v/L)\tan\alpha,$$

where v is speed of said movable body, $\alpha$ is a steering angle of said movable body, L is a distance between an axle of said movable body and the location of said antenna, and $\omega$ is an azimuth angle speed of said movable body, and integrates said azimuth angle speed $\omega$ of said movable body for a preset time and calculates said estimated azimuth angle of said movable body.

5. The tracking control device of claim 1, wherein said error calculation means outputs a difference between said estimated azimuth angle calculated by said estimated azimuth angle calculation means and said azimuth angle detected by said azimuth angle detection means as an error.

6. The tracking control device of claim 1, wherein said correction means calculates an arithmetical mean of said error calculated by said error calculation means and said directing angle error of said antenna.

7. The tracking control device of claim 1, wherein said correction means calculates a weighted mean of said error calculated by said error calculation means and said directing angle error of said antenna.

8. A tracking control device for an antenna disposed on a movable body so as to track a wave generating source, said tracking control device comprising:

a speed detection means for detecting an advancing speed of said movable body;

a steering angle detection means for detecting a steering angle of said movable body;

an estimated azimuth angle calculation means for calculating an estimated azimuth angle of said movable body by calculating azimuth angle speed of said movable body based on said advancing speed detected by said speed detection means and said steering angle detected by said steering angle detection means and by integrating said azimuth angle speed;

an azimuth angle detection means for detecting an azimuth angle of said movable body;

an error calculation means for outputting a difference between said estimated azimuth angle calculated by said estimated azimuth angle calculation means and said azimuth angle detected by said azimuth angle detection means as an error;

a directing angle error detection means for detecting an antenna directing angle error; and a correction means for correcting said antenna directing angle error, based on said error calculated by said error calculation means.

9. The tracking control device of claim 8, wherein said estimated azimuth angle calculation means calculates azimuth angle speed ω of said movable body by the following equation, $$\omega=(v/L)\tan\alpha,$$

where v is speed of said movable body, α is a steering angle of said movable body, L is a distance between an axle of said movable body and the location of said antenna, and ω is azimuth angle speed of said movable body, and integrates said azimuth angle speed ω of said movable body for a preset time and calculates said estimated azimuth angle of said movable body.

10. The tracking control device of claim 8, wherein said correction means is configured so as to calculate an arithmetical mean of said error calculated by said error calculation means and said directing angle error of said antenna.

11. The tracking control device of claim 8, wherein said correction means calculates a weighted mean of said error calculated by said error calculation means and said directing angle error of said antenna.

12. A tracking control method for an antenna disposed on a movable body so as to track a wave generating source, comprising:

(a) detecting a speed and a steering angle of said movable body;

(b) estimating an azimuth angle of said movable body, based on the detected speed and steering angle;

(c) detecting an azimuth angle of said movable body;

(d) calculating an error between the estimated azimuth angle and the detected azimuth angle;

(e) detecting an antenna directing angle error; and (f) correcting the detected antenna directing angle error, based on said error between said estimated azimuth angle and said detected azimuth angle.

13. The tracking control method of claim 12, wherein step (f) is a step to calculate a weighted mean of said azimuth angle error calculated in step (d) and said antenna directing angle error detected in step (e).

14. The tracking control device of claim 12, wherein step (b) is a step to estimate the azimuth angle of said movable body by calculating azimuth angle speed of said movable body and integrating said azimuth angle speed, based on said speed and said steering angle detected in step (a).

15. The tracking control method of claim 12, wherein step (b) is a step to calculate an azimuth angle speed ω of said movable body by the following equation, $$\omega=(v/L)\tan\alpha,$$

where v is speed of said movable body, α is a steering angle of said movable body, L is a distance between an axle of said movable body and the location of said antenna, and ω is an azimuth angle speed of said movable body, and integrate the azimuth angle speed ω of said movable body for a preset time and estimate said azimuth angle of said movable body.

16. The tracking control method of claim 12, wherein step (d) is a step to calculate a difference between said azimuth angle estimated in step (b) and said azimuth angle detected in step (c) as an error of said azimuth angle.

17. The tracking control method of claim 12, wherein step (f) is a step to calculate an arithmetical mean of said azimuth angle error calculated in step (d) and said antenna directing angle error detected in step (e).

18. A tracking control device for an antenna disposed on a movable body so as to track a wave generating source, said tracking control device comprising:

a speed detector to detect a speed of a movable body;

a steering angle detector to detect a steering angle of said movable body;

an azimuth angle estimator to calculate an estimated azimuth angle of said movable body, based on the speed detected by said speed detector and the steering angle detected by said steering angle detector;

an azimuth angle detector to detect an azimuth angle of said movable body;

an azimuth angle error estimator to calculate an error between said estimated azimuth angle calculated by said azimuth angle estimator and said azimuth angle detected by said azimuth angle detector;

an antenna directing angle error detector to detect an antenna directing angle error; and an antenna directing angle error corrector to correct said antenna directing angle error, based on said error calculated by said azimuth angle error estimator.

19. The tracking control device of claim 18, wherein said speed detector detects a speed of said movable body.

20. The tracking control device of claim 18, wherein said azimuth angle estimator calculates azimuth angle speed of said movable body based on said speed detected by said speed detector and said steering angle detected by said steering angle detector and calculates said estimated azimuth angle of said movable body by integrating said azimuth angle speed.

21. The tracing control device of claim 20, wherein said azimuth angle estimator calculates azimuth angle speed ω of said movable body by the following equation, $$\omega=(v/L)\tan\alpha,$$

where v is speed of said movable body, ω is a steering angle of said movable body, L is a distance between an axle of said movable body and the location of said antenna, and ω is an azimuth angle speed of said movable body, and integrates said azimuth angle speed ω of said movable body for a preset time and calculates said estimated azimuth angle of said movable body.

22. The tracking control device of claim 18, wherein said azimuth angle error estimator outputs a difference between said estimated azimuth angle calculated by said azimuth angle estimator and said azimuth angle detected by said azimuth angle detector as an error.

23. The tracking control device of claim 18, wherein said antenna directing angle error corrector calculates an arithmetical mean of said error calculated by said azimuth angle error estimator and said directing angle error of said antenna.

24. The tracking control device of claim 18, wherein said antenna directing angle error corrector calculates a weighted mean of said error calculated by said azimuth angle error estimator and said directing angle error of said antenna.

25. A tracking control device for an antenna disposed on a movable body so as to track a wave generating source, said tracking control device comprising:

a speed detector to detect an advancing speed of said movable body;

a steering angle detector to detect a steering angle of said movable body;

an azimuth angle estimator to calculate an estimated azimuth angle of said movable body by calculating azimuth angle speed of said movable body based on said speed detected by said speed detector and said steering angle detected by said steering angle detector and by integrating said azimuth angle speed;

an azimuth angle detector to detect an azimuth angle of said movable body;

an azimuth angle error estimator to output a difference between said estimated azimuth angle calculated by said azimuth angle estimator and said azimuth angle detected by said azimuth angle detector as an error;

an antenna directing angle error detector to detect an antenna directing angle error; and an antenna directing angle error corrector to correct said antenna directing angle error, based on said error calculated by said azimuth angle error estimator.

26. The tracking control device of claim 25, wherein said azimuth angle estimator calculates azimuth angle speed $\omega$ of said movable body by the following equation:

$$\omega=(v/L)\tan\alpha,$$

where v is speed of said movable body, $\alpha$ is a steering angle of said movable body, L is a distance between an axle of said movable body and the location of said antenna, and $\omega$ is azimuth angle speed of said movable body, and integrates said azimuth angle speed $\omega$ of said movable body for a preset time and calculates said estimated azimuth angle of said movable body.

27. The tracking control device of claim 25, wherein said antenna directing angle error corrector is configured so as to calculate an arithmetical mean of said error calculated by said azimuth angle error estimator and said directing angle error of said antenna.

28. The tracking control device of claim 25, wherein said antenna directing angle error corrector calculates a weighted mean of said error calculated by said azimuth angle error estimator and said directing angle error of said antenna.

* * * * *